US011386835B2

(12) United States Patent
Mosier et al.

(10) Patent No.: US 11,386,835 B2
(45) Date of Patent: Jul. 12, 2022

(54) PIXEL CONTROL ARCHITECTURE FOR MICRO-LED MICRO-DISPLAY WITH REDUCED TRANSISTOR COUNT

(71) Applicant: Rockwell Collins, Inc., Cedar Rapids, IA (US)

(72) Inventors: Donald E. Mosier, Cedar Rapids, IA (US); Michael A. Ropers, Cedar Rapids, IA (US); Jana Wills, West Linn, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 17/210,118

(22) Filed: Mar. 23, 2021

(65) Prior Publication Data

US 2021/0312857 A1 Oct. 7, 2021

Related U.S. Application Data

(60) Provisional application No. 63/006,562, filed on Apr. 7, 2020.

(51) Int. Cl.
*G09G 3/32* (2016.01)

(52) U.S. Cl.
CPC ..... *G09G 3/32* (2013.01); *G09G 2300/0452* (2013.01); *G09G 2300/0804* (2013.01); *G09G 2320/0646* (2013.01)

(58) Field of Classification Search
CPC ..... G09G 3/32; G09G 2300/0452; G09G 2320/0646; G09G 2300/0804
See application file for complete search history.

(56) References Cited

U.S. PATENT DOCUMENTS

2007/0176862 A1* 8/2007 Kurt ..... G09G 3/2092 345/82
2009/0322802 A1* 12/2009 Noguchi ..... G09G 3/2003 345/694
2014/0285542 A1* 9/2014 Izumi ..... G09G 3/3233 345/694
2014/0313110 A1* 10/2014 Ito ..... G09G 3/3233 345/77
2015/0332628 A1 11/2015 Ren et al.
2017/0345370 A1 11/2017 Hack et al.
2018/0293942 A1 10/2018 Gu et al.

FOREIGN PATENT DOCUMENTS

CN 110706653 A 1/2020

OTHER PUBLICATIONS

Extended Search Report for European Application No. 21167219.1 dated Aug. 27, 2021, 12 pages.

* cited by examiner

*Primary Examiner* — Muhammad N Edun
(74) *Attorney, Agent, or Firm* — Suiter Swantz pc llo

(57) ABSTRACT

In a display with subpixel LEDs, each pixel includes two subpixel LEDs controlled via a shared control circuit and switching element. Switching element logic allows one set of brightness control transistors to alternatively control two subpixels. The driving and control elements of a display backplane are organized into pixels units of four driving elements and three control elements. Each pixel may comprise two green subpixels controlled via the switching element. Alternatively, each pixel may comprise a white subpixel that only illuminates when the colored pixels are off; the green and white subpixels are controlled via the switching element.

10 Claims, 5 Drawing Sheets

| INPUTS | | | | OUTPUTS | | |
|---|---|---|---|---|---|---|
| MONO | RGBG | VIDEO | B0 | G1 | W/G2 | |
| 1 | 0 | 0 | 0 | G | G | |
| 1 | 0 | 0 | 1 | G | G | |
| 1 | 0 | 1 | 0 | X | X | INVALID |
| 1 | 0 | 1 | 1 | X | X | INVALID |
| 1 | 1 | 0 | 0 | X | X | INVALID |
| 1 | 1 | 0 | 1 | X | X | INVALID |
| 1 | 1 | 1 | 0 | X | X | INVALID |
| 1 | 1 | 1 | 1 | X | X | INVALID |
| 0 | 0 | 0 | 0 | G | 0 | |
| 0 | 0 | 0 | 1 | G | 0 | |
| 0 | 0 | 1 | 0 | G | 0 | |
| 0 | 0 | 1 | 1 | 0 | G | |
| 0 | 1 | 0 | 0 | G | 0 | |
| 0 | 1 | 0 | 1 | G | 0 | |
| 0 | 1 | 1 | 0 | G | G | |
| 0 | 1 | 1 | 1 | G | G | |

FIG. 3

| INPUTS | | | OUTPUTS | | |
|---|---|---|---|---|---|
| MONO | VIDEO | B0 | G1 | W/G2 | |
| 1 | 1 | 0 | G | G | |
| 1 | 1 | 1 | G | G | |
| 1 | 1 | 0 | X | X | INVALID |
| 1 | 1 | 1 | X | X | INVALID |
| 0 | 0 | 0 | G | 0 | |
| 0 | 0 | 1 | G | 0 | |
| 0 | 1 | 0 | G | 0 | |
| 0 | 1 | 1 | 0 | G | |

FIG.5

PIXEL CONTROL ARCHITECTURE FOR MICRO-LED MICRO-DISPLAY WITH REDUCED TRANSISTOR COUNT

PRIORITY

The present application claims the benefit under 35 U.S.C. § 119(e) of U.S. Provisional App. No. 63/006,562 (filed Apr. 7, 2020), which is incorporated herein by reference.

BACKGROUND

Helmet mounted or head worn micro-displays require high brightness and high resolution in a small area (such as a one-inch square). Some state-of-the-art displays include four subpixels that comprise each pixel. Such displays require separate control circuitry for each addressable display element.

To enable the required brightness, a current drive transistor is required for each subpixel and occupies a significant portion of the area available for display control. High-quality graphics requires very fine control of gray scale (brightness levels) for each subpixel. Such control requires a complicated control circuit with many transistors. High transistor count leads to poor process yields and correspondingly high product costs. Simultaneously, the control transistors must be made very small to fit within the available space. Space constraints necessitate the use of very small geometry semiconductor processes with high recurring and non-recurring costs and waste.

SUMMARY

In one aspect, embodiments of the inventive concepts disclosed herein are directed to a display with subpixel LEDs where two of the subpixel LEDs are controlled via a shared control circuit and switching element. Switching element logic allows one set of brightness control transistors to alternatively control two subpixels. The driving and control elements of a display backplane are organized into pixels units of four driving elements and three control elements.

In a further aspect, each pixel comprises two green subpixels controlled via the switching element. Alternatively, each pixel comprises a white subpixel that only illuminates when the colored pixels are off; the green and white subpixels are controlled via the switching element.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which:

FIG. 3 shows a chart of digital inputs and outputs for a switching element according to an exemplary embodiment;

FIG. 5 shows a chart of digital inputs and outputs for a switching element according to an exemplary embodiment;

DETAILED DESCRIPTION

Figure 1:
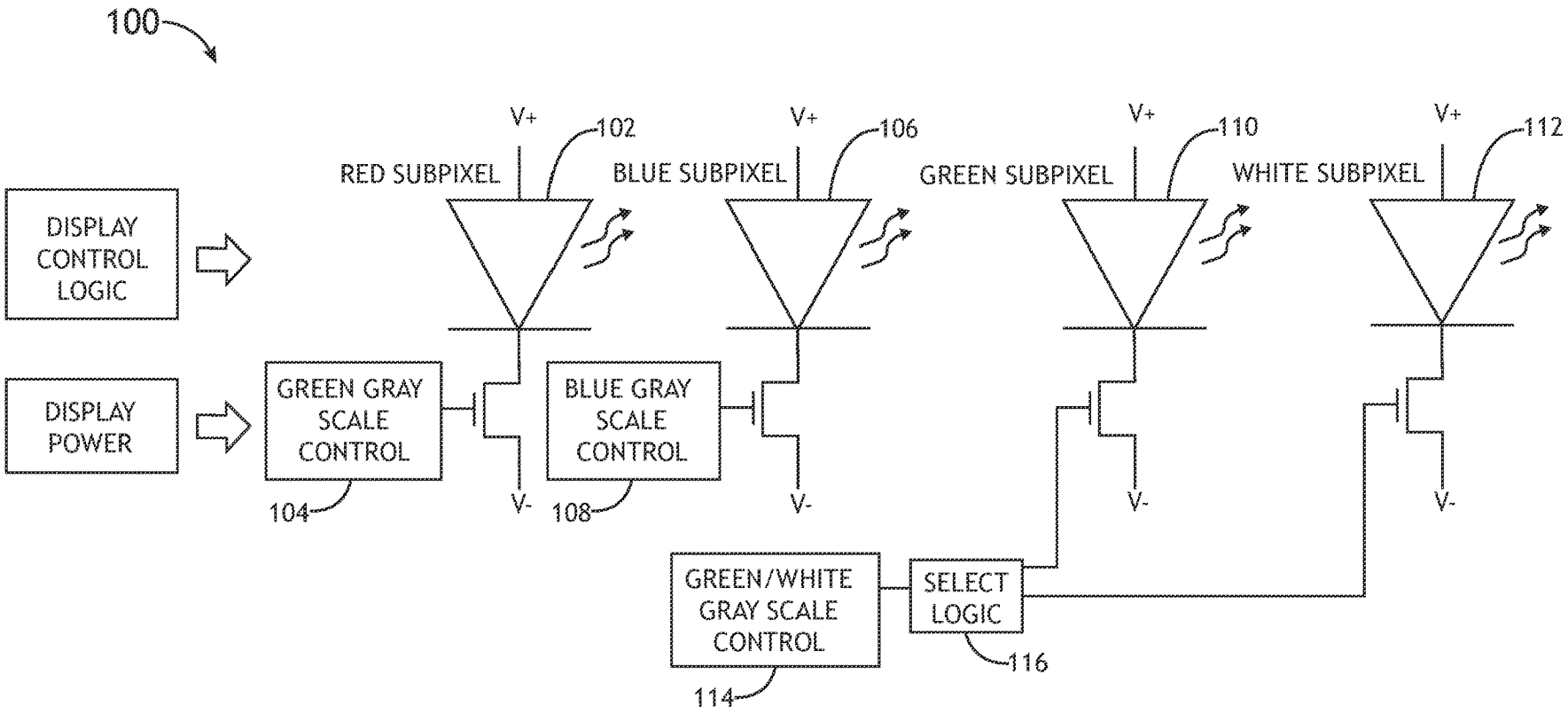
FIG. 1 shows a block diagram of a pixel, including subpixels, and control elements according to an exemplary embodiment.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a display with subpixel LEDs where two of the subpixel LEDs are controlled via a shared control circuit and switching element. Switching element logic allows one set of brightness control transistors to alternatively control two subpixels. The driving and control elements of a display backplane are organized into pixels units of four driving elements and three control elements. The architecture of a pixel comprising four subpixels and the corresponding drive elements may be more fully understood with respect to U.S. patent application Ser. No. 16/704,322 "DISPLAY ELEMENT, SYSTEM, AND METHOD" (filed Dec. 5, 2019).

Referring to FIG. 1, a block diagram of a pixel 100, including subpixels 102, 106, 110, 112, and control elements 104, 108, 114 according to an exemplary embodiment is shown. Each subpixel 102, 106, 110, 112 is driven by an independent current drive transistor. The brightness of each subpixel 102, 106, 110, 112 is controlled via a set of transistors embodying a corresponding control element 104, 108, 114. One of the control elements 104, 108, 114 is configured to control the brightness level of two related subpixels 110, 112 in the alternative or in concert.

In at least one embodiment, the pixel 100 comprises a first, red subpixel 102 controlled by a first control element 104 and a second, blue subpixel 106 controlled by a second control element 108. A third, green subpixel 110 and a fourth, white subpixel 112 are controlled by a third control element 114. A switching element 116 alternatively diverts a control signal to either the third, green subpixel 110 or the fourth, white subpixel 112 based on a set of inputs as more fully described herein. In such embodiment, the fourth, white subpixel 112 is never driven at the same time as the other subpixels 102, 106, 110.

In at least one embodiment, the pixel 100 comprises a first, red subpixel 102 controlled by a first control element 104 and a second, blue subpixel 106 controlled by a second control element 108. A third, primary green subpixel 110 and a fourth, secondary green subpixel 112 are controlled by a third control element 114. A switching element 116 may apply a control signal to the third, primary green subpixel 110 alone, or also to the fourth, secondary green subpixel 112 based on a set of inputs. In such embodiment, the fourth, secondary green subpixel 112, if driven, is driven at the same brightness as the third, primary green subpixel 110.

In at least one embodiment, where the display is monochrome, each subpixel 102, 106, 110, 112 comprises a green subpixel 102, 106, 110, 112. The control elements 104, 108, 114 may set the brightness for each subpixel 102, 106, 110, 112 at substantially the same value. In such embodiment, the switching element 116 may be connected to and apply the same signal to each subpixel 102, 106, 110, 112. Alternatively, or in addition, a first set of subpixels 102, 106 may be controlled via corresponding control elements 104, 108 and related subpixels 110, 112 are controlled via a combined control element 114 via the switching element 116.

In at least one embodiment, the control elements 104, 108, 114 and switching element 116 may be embodied in a backplane while the subpixels 102, 106, 110, 112 are embodied in a separate LED plane. Because the switching element 116 may be addressed via inputs to drive either or both of the connected subpixels 110, 112, the same backplane architecture may be utilized for a monochrome LED plane, a red-green-blue-white LED plane, and a red-green-blue-green LED plane.

Figure 2:
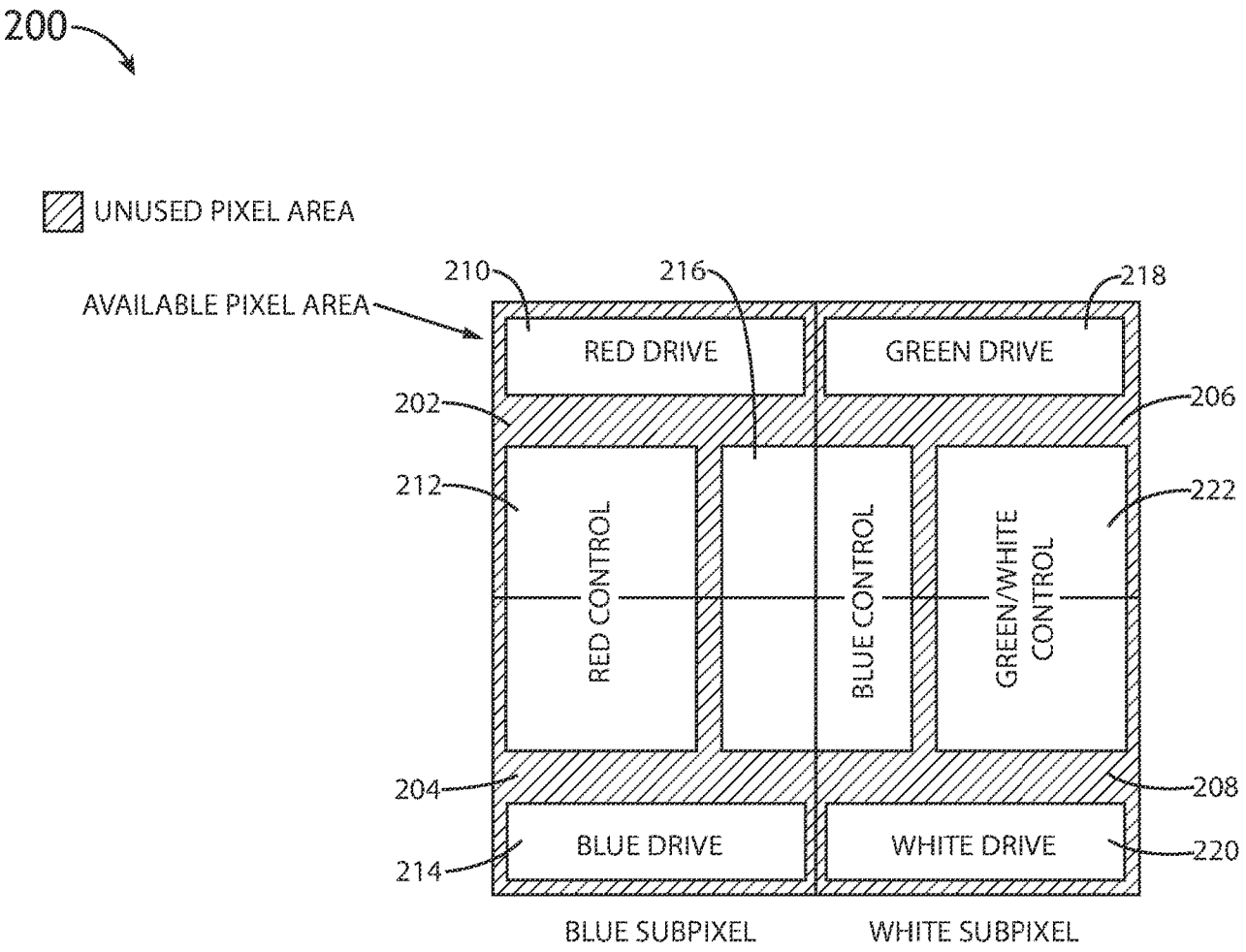
FIG. 2 shows a block diagram of a pixel according to an exemplary embodiment.

Referring to FIG. 2, a block diagram of a pixel 200 according to an exemplary embodiment is shown. The pixel 200 comprises four subpixels 202, 204, 206, 208. Each subpixel 202, 204, 206, 208 is driven by a corresponding current drive transistor 210, 214, 218, 220. In at least one embodiment, the current drive transistors 210, 214, 218, 220 may be disposed to maximize available space for control elements 212, 216, 222.

In at least one embodiment, one of the control elements 212, 216, 222 may comprise a combined control element 222 configured to control the brightness of two related subpixels 206, 208, either alternatively or in concert. The combined control element 222 may include a switching element/selection logic for determining which of the related subpixels 206, 208 to illuminate.

In at least one embodiment, the current drive transistors 210, 214, 218, 220 and control elements 212, 216, 222 may be embodied in a backplane, separate from an LED plane, such that the backplane may be configured to drive subpixels 202, 204, 206, 208 in any LED plane with substantially similar layout, regardless of the composition of the subpixels 202, 204, 206, 208.

Figure 4:
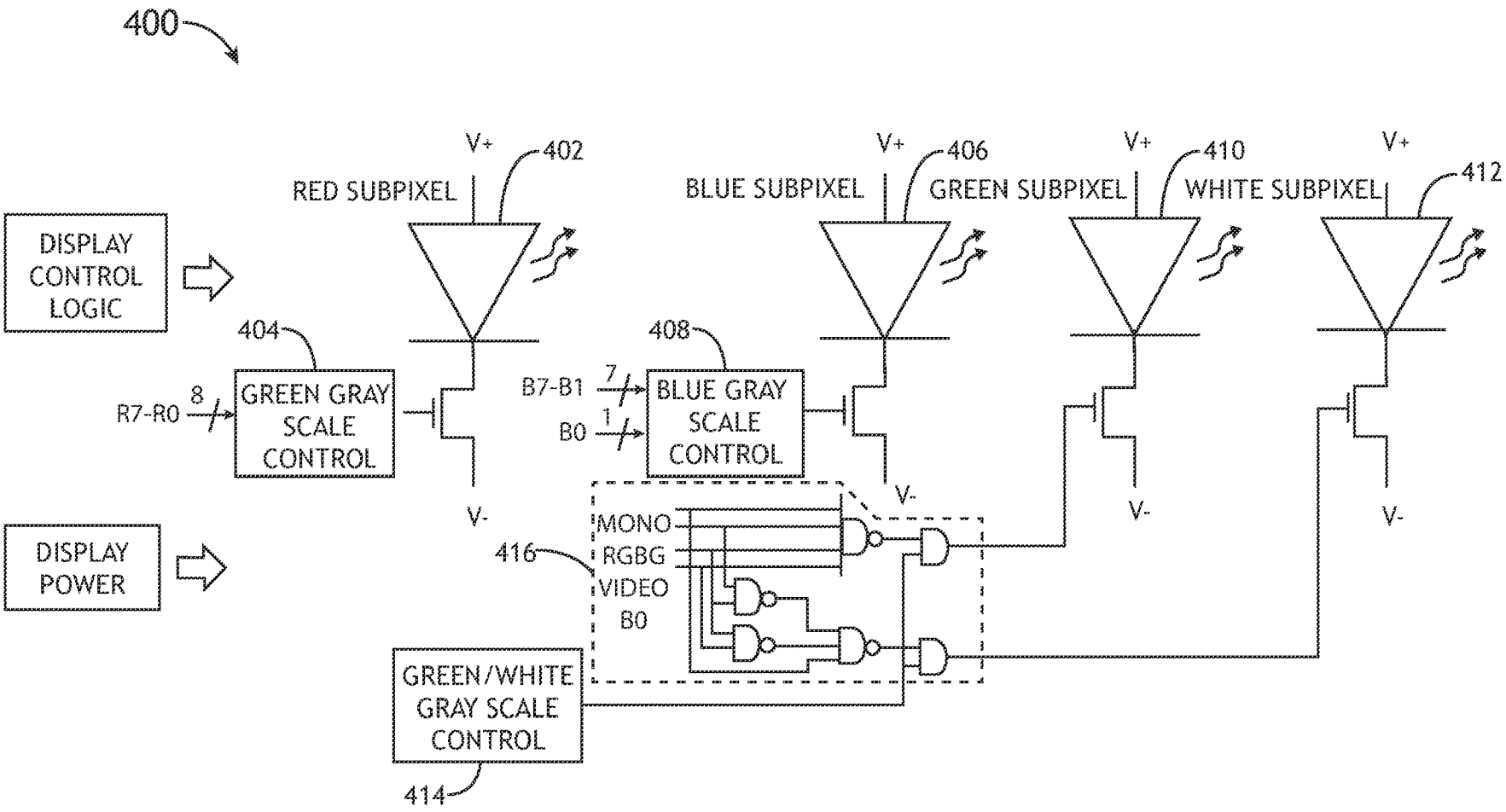
FIG. 4 shows a block diagram of a pixel, including subpixels, and control elements according to an exemplary embodiment.

Referring to FIG. 4, a block diagram of a pixel 400, including subpixels 402, 406, 410, 412, and control elements 404, 408, 414 according to an exemplary embodiment is shown. Each subpixel 402, 406, 410, 412 is driven by an independent current drive transistor, controlled via corresponding control element 404, 408, 414. One of the control elements 404, 408, 414 is configured to control the brightness level of two related subpixels 410, 412 in the alternative or in concert. The pixel 400 may comprise a red-blue-green-white subpixel layout, a green monochrome subpixel layout, a red-green-blue-green subpixel layout, or any other subpixel layout wherein at least two subpixels 402, 406, 410, 412 are sufficiently related to allow their brightness values to be set in the alternative or in concert.

In at least one embodiment, a switching element 416 comprises selection logic that receives a plurality of inputs to determine which of the two related subpixels 410, 412 to illuminate. In at least one embodiment, the inputs may receive a set of bits indicating the type of LED plane (e.g. monochrome or red-green-blue-green) and whether a secondary green subpixel should be driven.

In at least one embodiment, the inputs may also comprise one or more input bits of other control elements 404, 408. For example, least significant bits intended for a blue subpixel control element 408 may be received by the switching element 416. One exemplary chart of inputs and corresponding outputs are shown in FIG. 3 (output "G" indicating corresponding related subpixel 404, 408 is illuminated and output "0" indicating it is not).

In one exemplary embodiment, where an input bit indicates a monochrome LED plane ("Mono" equals 1 in FIG. 3), a combined control element 414 will always drive both related pixels 410, 412. Where an input bit indicates a red-green-blue-green LED plane ("RGBG" equals 1 in FIG. 3), the combined control element 414 will illuminate a secondary green subpixel in the related subpixels 410, 412 to the same brightness as a primary green subpixel if another bit indicates that the least significant bit of the blue sub pixel control element 408 should be used to determine which of the related subpixels 410, 412 to drive ("Video" equals 1 in FIG. 3). It may be appreciated that the least significant bit of a color channel is only an exemplary embodiment; any bit in the video stream may be used. Where none of the Mono, RBGB, or Video inputs indicates those states, the LED plane may be assumed to be a red-green-blue-white LED plane. In that case, because none of the color specific subpixels 402, 406, 410 would be illuminated at the same time as a white subpixel 412, a least significant bit of one or more control signals to the non-combined control elements 404, 408 may indicate if the combined control element 414 should illuminate the white subpixel 412 ("B0 equals 1 in FIG. 3). It may be appreciated that the actual values may depend on the architecture of the selection logic in the switching element 416. For clarity and simplicity, FIG. 5 shows a similar chart of digital inputs to the switching element 416 wherein the RGBG input is removed. The switching element 416 may still be addressable to illuminate one or both of the related subpixels 410, 412.

A display according to the present disclosure may have a backplane with a 25% reduction in the number of control transistors; improving yield up to 25% and reducing recurring cost. The required chip area is also reduced, allowing larger, cheaper semiconductor node size to be used (75 nm or larger as compared to 65 nm), reducing process waste. Furthermore, space and complexity savings may allow for a corresponding increase in brightness control complexity from eight-bit to ten-bit.

It should be appreciated that while exemplary embodiments described herein were directed to pixels comprised of four subpixels, other embodiments are envisioned. For example, five or six subpixels are also possible. Any embodiment wherein at least two subpixels are controlled by a single control element is envisioned. Furthermore, multiple sets of related subpixels within a pixel may each be controlled a separate single control element.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A backplane element for a display comprising:

a plurality of pixel driving elements, each pixel driving element comprising:

four subpixel power elements, each configured to drive a subpixel;

three subpixel control elements; and a control switch, wherein:

a first subpixel control element is configured to set a brightness level of a first subpixel;

a second subpixel control element is configured to set a brightness level of a second subpixel;

a third subpixel control element is configured to set a brightness level of a third subpixel or a fourth subpixel;

the control switch is configured to switch the third subpixel control element between the third subpixel and the fourth subpixel;

an LED plane comprises one red subpixel LED, one blue subpixel LED, and two green subpixel LEDs;

the two green subpixel LEDs are controlled via the third subpixel control element; and the third subpixel control element is configured to either drive a first green subpixel and not a second green subpixel, or drive the first green subpixel and second green subpixel at a same brightness.

2. The backplane element of claim 1, wherein the control switch comprises a plurality of gates, the plurality of gates being driven by a plurality of inputs.

3. The backplane element of claim 2, wherein one of the plurality of inputs comprises bits in a video stream, each bit associated with one of the plurality of pixel driving elements such that the plurality of gates for each pixel driving element is individually addressable via the video stream.

4. The backplane element of claim 1, wherein the plurality of pixel driving elements comprise a semiconductor node size between 90 nm and 75 nm.

5. The backplane element of claim 1, wherein the three subpixel control elements are each configured to receive a ten-bit brightness level control signal.

6. A display comprising:

an LED plane comprising a plurality of pixels, each pixel comprising four subpixel LEDs; and a backplane configured to drive the subpixel LEDs in the LED plane, the backplane comprising:

a plurality of pixel driving elements, each pixel driving element comprising:

four subpixel power elements, each configured to drive a subpixel LED;

three subpixel control elements; and a control switch, wherein:

a first subpixel control element is configured to set a brightness level of a first subpixel LED;

a second subpixel control element is configured to set a brightness level of a second subpixel LED;

a third subpixel control element is configured to set a brightness level of a third subpixel LED or a fourth subpixel LED;

the control switch is configured to switch the third subpixel control element between the third subpixel LED and the fourth subpixel LED;

each pixel of the LED plane comprises one red subpixel LED, one blue subpixel LED, and two green subpixel LEDs;

the two green subpixel LEDs are controlled via the third subpixel control element; and the third subpixel control element is configured to either drive a first preen subpixel and not a second green subpixel, or drive the first green subpixel and second green subpixel at a same brightness.

7. The display of claim 6, wherein the control switch comprises a plurality of gates, the plurality of gates being driven by a plurality of inputs.

8. The display of claim 7, wherein one of the plurality of inputs comprises bits in a video stream, each bit associated with one of the pixels such that the plurality of gates for each pixel is individually addressable via the video stream.

9. The display of claim 6, wherein the plurality of pixel driving elements comprise a semiconductor node size between 90 nm and 75 nm.

10. The display of claim 6, wherein the three subpixel control elements are each configured to receive a ten-bit brightness level control signal.

* * * * *